US005619743A

United States Patent [19]

Mogi et al.

[11] Patent Number: 5,619,743

[45] Date of Patent: Apr. 8, 1997

[54] METHOD OF PROCESSING A PHOTOSENSITIVE MATERIAL AND PHOTOGRAPHIC PROCESSING APPARATUS

[75] Inventors: Fumio Mogi; Takatoshi Ishikawa, both of Kanagawa, Japan

[73] Assignee: Fuji Photo Film Co., Ltd., Kanagawa, Japan

[21] Appl. No.: 466,748

[22] Filed: Jun. 6, 1995

[30] Foreign Application Priority Data

Jun. 13, 1994 [JP] Japan ..... 6-130053

[51] Int. Cl.[6] ..... G03D 7/00

[52] U.S. Cl. ..... 396/577

[58] Field of Search ..... 354/298, 299, 354/322–324; 430/351, 383, 403; 134/64 P, 64 R, 122 P, 122 R; 219/475–478

[56] References Cited

U.S. PATENT DOCUMENTS

| | | | |
|---|---|---|---|
| 4,920,252 | 4/1990 | Yoshino | 219/497 |
| 5,116,721 | 5/1992 | Yamamoto | 430/351 |
| 5,486,890 | 1/1996 | Mogi | 354/299 |

FOREIGN PATENT DOCUMENTS

| | | | |
|---|---|---|---|
| 4-141646 | 5/1992 | Japan | 354/297 |

*Primary Examiner*—D. Rutledge

*Attorney, Agent, or Firm*—Sughrue, Mion, Zinn, Macpeak & Seas

[57] ABSTRACT

A photographic processing apparatus efficiently processes color photographic film and color printing paper. Intermediate portions of pipes for circulating processing solutions which communicate with a bleaching tank, first and second fixing tanks, a wash tank and first and second stabilizing bath tanks of a film processing section, and a bleaching/fixing tank and first through third rinsing tanks of a printing paper processing section penetrate a metal block of a cast heater so that the pipes are coupled together by the metal block for efficient heat transmission. A heater is provided inside the metal block to uniformly heat the processing solutions which flow through the pipes. Heat is exchanged among the processing solutions flowing through the pipes so that the processing solutions in the bleaching tank through the second stabilizing bath tank of the film processing section and the bleaching/fixing tank through the third rinsing tank of the printing paper processing section are effectively maintained at the roughly same temperature.

10 Claims, 6 Drawing Sheets

METHOD OF PROCESSING A PHOTOSENSITIVE MATERIAL AND PHOTOGRAPHIC PROCESSING APPARATUS

BACKGROUND OF THE INVENTION

1. Field of the Invention

The present invention relates to a photographic processing apparatus which comprises a film processing section for developing photographic film and a printing paper processing section for developing printing paper having an image formed thereon by an exposure process. Also, the present invention relates to a method of processing a photosensitive material which can quickly process the photosensitive material in the above-described photographic processing apparatus.

2. Description of the Related Art

A photographic processing apparatus is known in which a film processing unit and a printing processing unit are formed integrally. In such a processing apparatus, photographic film on which images have been photographed successively undergoes a developing process, a fixing process, a washing process, and a drying process in the film processing unit. Then, images recorded on the photographic film thus developed are printed on printing paper by exposure, after which the printing paper undergoes a developing process, a fixing process, a washing process, and a drying process in the printing processing unit to obtain photographic prints. With this type of processing apparatus, it is possible to consecutively perform various processes starting from a developing process of photographic film on which images have been photographed, to an exposure process for printing images recorded on the photographic film on printing paper by exposure and further to a developing process for developing the printing paper on which images have been printed by exposure. Accordingly, photographic prints can be obtained from a photographic film using a single apparatus.

In the above-described photographic processing apparatus, processing tanks for developing, fixing, and washing photographic film, and processing tanks for developing, fixing, and washing printing paper are separately provided, in addition to a drying section. Processing solutions in these processing tanks are maintained at respective predetermined temperatures equal to or less than 38° C. to quickly process the photographic film and the printing paper under optimal conditions. Processing solutions in the film processing unit and the printing paper processing unit are controlled by separate temperature adjusting means and circulating means such that the photographic film and the printing paper can be processed under optimal conditions.

However, conventional integral-type photographic processing apparatuses in which processes from the development of negative film to the exposure and development of printing paper are performed consecutively in one apparatus are nothing more than a simple aggregation of a film processing unit and a printing processing unit, for no attempts have been made to, for example, simplify the means for maintaining the temperatures of the processing solutions, reduce the number of parts, set temperatures of the respective processing solutions in easier manner, or process a color photosensitive material quickly. Accordingly, such conventional photographic processing apparatuses are relatively large and the space therefor to be installed is limited. Also, the conventional apparatuses have high operating costs, and cannot effectively carry out the processes including developing of photographic film, exposure of printing paper, and development of the printing paper.

SUMMARY OF THE INVENTION

In view of the above-described problems, an object of the present invention is to provide a method of processing a photosensitive material which can quickly process a color photosensitive material.

Another object of the present invention is to provide a photographic processing apparatus which achieves a reduced size, a reduction of manufacturing costs by reduced number of parts, and a reduction in operating costs, and which can effectively process a color photosensitive material.

According to a first aspect of the present invention, there is provided a method of developing a color photosensitive material which has been exposed, using a plurality of processing solutions including a developing solution. The color photosensitive material is developed in the state in which the developing solution is maintained at a predetermined temperature equal to or higher than 40° C., and all the processing solutions except the developing solution are maintained at predetermined temperatures in a range from at least 38° C. to at most 50° C. while maintaining the temperature differences between the processing solutions except the developing solution to be less than or equal to 2° C.

According to a second aspect of the present invention, there is provided a photographic processing apparatus which includes a film processing section in which color photographic film which has been exposed is developed using processing solutions which are stored in a plurality of processing tanks including a developing tank and are maintained at predetermined temperatures, an image exposure section for printing images of the color photographic film which has undergone the developing process on color printing paper by exposure, and a printing paper processing section in which the color printing paper on which the images have been printed by exposure is developed using processing solutions which are stored in a plurality of processing tanks including a developing tank and are maintained at predetermined temperatures wherein the temperature differences between the processing solutions except the developing solutions of the film processing section and the printing paper processing section are maintained to be less than or equal to 2° C.

In use of the photographic processing apparatus just mentioned above, the developing solution of the film processing section and the developing solution of the printing paper processing section are preferably maintained at respective predetermined temperatures equal to or higher than 40° C., and all the processing solutions except the developing solution of the film processing section and the developing solution of the printing paper processing section are maintained at predetermined temperatures in a range from at least 38° C. to at most 50° C.

Preferably, the processing solution except the developing solution of the film processing section and the developing solution of the printing paper processing section are heated by at most two heat sources, and at least one of the heat sources is a cast heater in which said at least one heat source and pipes for circulating a plurality of processing solutions to be heated by said at least one heat source are tightened and coupled together by hardening a metallic material having a high heat conductivity tightly around said at least one heat source and said pipes.

Preferably, all the processing solutions except the developing solution of the film processing section and the developing solution of the printing paper processing section are maintained at predetermined temperatures by a single cast heater.

It is a general practice that processing solutions, including developing solutions, for processing a color photosensitive material are maintained at predetermined temperatures equal to or lower than 38° C. In contrast, in the method according to the present invention, developing solutions are maintained at a temperature equal to or higher than 40° C. while all the processing solutions except the developing solutions are maintained at predetermined temperatures in a range from at least 38° C. to at most 50° C. As a result, a color photosensitive material can be processed in a shorter time.

Also, since the temperature differences between the processing solutions except the developing solutions are maintained to be less than or equal to 2° C., it is possible to prevent the processing solutions except the developing solutions from affecting each other and from becoming instable. Accordingly, the color photosensitive material can be processed to have a consistent quality.

The photographic processing apparatus according to the second aspect of the invention is a photographic processing apparatus of the so-called N-P integral type in which color photographic film is first subject to a developing process, and then images recorded on the developed color photographic film are printed on color printing paper, which is then subjected to a developing process. In such a photographic processing apparatus, the temperature differences between the processing solutions except the developing solution of the film processing section and the developing solution of the printing paper processing section are maintained to be less than or equal to 2° C. Accordingly, even when the processing tanks for storing the processing solutions except the developing solutions are arranged close to each other, the temperatures of the process solutions do not affect each other. This makes it possible to arrange the processing tanks in a reduced space, thereby decreasing the size of the apparatus.

It should be noted that when the developing solutions of the photographic processing apparatus of the present invention are maintained at predetermined temperatures equal to or higher than 40° C. while all the processing solutions except the developing solutions are maintained at predetermined temperatures in a range from at least 38° C. to at most 50° C., not only color photographic film but also color printing paper can be quickly processed in a stable manner.

As described above, in the photographic processing apparatus of the present invention, the processing solutions except the developing solutions which develop color photographic film and color printing paper are preferably heated by at most two heat sources, so as to maintain the processing solutions at predetermined temperatures.

In order to process and develop color photographic film and color printing paper, various kinds of processing solutions such as a bleaching solution, a fixing solution (or a bleaching/fixing solution), washing water, and a stabilizing solution are required in addition to a developing solution. When these processing solutions are heated by separate heat sources provided for the respective processing solutions, the apparatus consumes considerable amounts of electrical power. In the present invention, since all the processing solutions are heated by at most two heat sources, the electrical power consumed by the apparatus can be decreased so that the reduction in a running cost can be achieved. In this case, use of a cast heater can effectively heat and maintain a plurality of processing solutions at a substantially constant temperature.

The cast heater is formed by integrally tightening pipes for circulating respective processing solutions, together with a heat source, by means of a metallic material of a high heat conductivity hardened around the pipes and the heat source. With this structure, heat from the heater can be effectively transferred to the processing solutions flowing through the pipes, and heat conduction among the processing solutions can also be performed mutually. Accordingly, it is very easy to maintain the plurality of processing solutions within a predetermined temperature range.

When the number of heat sources is reduced, the number of cooling fans used accompanying the heat sources and various parts used for controlling the operation of the heat sources and the fans or the like can also be reduced, thereby preventing the production costs of the apparatus from increasing.

Also, as described above, in the photographic processing apparatus of the present invention, the processing solutions except the developing solutions are heated by a single heat source using the so-called cast heater. This can be achieved by selecting the processing solutions except the developing solutions so that the temperature differences between the processing solutions except the developing solutions are less than or equal to 2° C. By this, it becomes possible to effectively control the temperatures of various processing solutions using a mechanism having a simple structure. Moreover, the above-described object of the present invention, i.e., reduction of the size of the apparatus, reduction of the running costs, etc., can be effectively achieved.

The difference in temperature between the developing solution for color photographic film and the developing solution for color printing paper is preferably at most 2° C. and more preferably at most 1.5° C. Also, the temperature of each developing solution is preferably controlled in the range of ±0.5° C.

Next, processing solutions including developing solutions according to the present invention which are suitable for processing a color photosensitive material will be described. Namely, a description will be given of developing solutions which can stably process a color photosensitive material at a temperature equal to or higher than 40° C. and processing solutions which can process the developed color photosensitive material at temperatures in a range from at least 38° C. to at most 50° C. to obtain prints having a high quality.

The developing solutions (color developing solutions) used in the present invention preferably contain, as a main component, an art-recognized aromatic primary amine color developing agent. Preferred examples are p-phenylenediamine derivatives. Typical examples of such derivatives include N,N-diethyl-p-phenylenediamine, 2-amino-5-diethylaminotoluene, 2-amino-5-(N-ethyl-N-laurylamino-)toluene, 3-methyl-4-[N-ethyl-N-(β-hydroxyethyl)amino] aniline, 3-methyl-4-[N-ethyl-N-(δ-hydroxybutyl)amino] aniline, 2-methyl-4-[N-ethyl-N-(β-hydroxyethyl)amino] aniline, 4-amino-3-methyl-N-ethyl-N-[β-(methanesulfonamide)ethyl]aniline, N-(2-amino-5-diethylaminophenylethyl)methanesulfonamide, N,N-dimethyl-p-phenylenediamine, 4-amino-3-methyl-N-ethyl-N-methoxyethylaniline, 4-amino-3-methyl-N-ethyl-N-β-ethoxyethylaniline, and 4-amino-3-methyl-N-ethyl-N-β-butoxyethylaniline. Among them, particularly preferred are 4-amino-3-methyl-N-ethyl- N-[β-(methanesulfonamide-)ethyl]aniline, 2-methyl-4-[N-ethyl-N-(β-hydroxyethyl)amino]aniline, and 2-methyl-4-[N-ethyl-N-(δ-hydroxybutyl)amino]aniline.

Among the above-described compounds, 4-amino-3-methyl-N-ethyl-N-[β-(methanesulfonamide)ethyl]-aniline, and 3-methyl-4-[N-ethyl-N-(β-hydroxyethyl)amino]aniline are preferably used in the embodiments of the present invention.

The above p-phenylenediamine derivatives may be salts of sulfuric acid, hydrochloric acid, sulfurous acid, or p-toluenesulfonic acid. Although the aromatic primary amine developing agent must be used in an amount equal to or greater than about 0.15 mol per liter of developing solution (mol/liter), it is preferably used in an amount of 0.17–0.50 mol/liter. Also, the color developing agent is preferably included in a replenishing solution for the developing solution in an amount of about 0.17–0.60 mol, more preferably about 0.2–0.8 mol, per liter of replenishing solution.

To increase the durability of tank materials, use of a developing solution which is substantially benzyl alcohol-free is recommended. The term "substantially benzyl alcohol-free" means that the concentrations of benzyl alcohol is not greater than 2 ml/liter and preferably not greater than 0.5 ml/liter. Most preferably, the developing solution contains no benzyl alcohol.

The developing solution may contain hydroxylamine, ions of sulfurous acid, or the like. Also, the developing solution preferably contains other organic preservatives.

The term "organic preservatives" covers all the organic compounds which can decelerate the speed of deterioration of the aromatic primary amine color developing agents by addition thereof. That is, the organic preservatives are organic compounds having the function of preventing the oxidation of color developing agents due to contact with air. Preferred examples of effective organic preservatives include hydroxylamine derivatives (other than hydroxylamine), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring amines. Especially, it is preferred to add alkanol amines such as triethanolamine; dialkylhydroxylamines such as N,N-diethylhydroxylamine or N,N-di(sulfoether)hydroxylamine; hydrazine derivatives such as N,N-bis(carboxymethyl)hydrazine (other than hydrazine); and aromatic polyhydroxy compounds such as sodium catechol-3,5-disulfonate.

An anti-fogging agent may be added to the developing solutions as needed. An alkali metal halide such as sodium chloride, potassium bromide or potassium iodide, or an organic anti-fogging agent can be used as the anti-fogging agent. Typical examples of the organic anti-fogging agent include nitrogen-containing hetero cyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethylbenzimidazole, indazole, hydroxyazaindolizine, and adenine.

When the above-described developing solutions are used in the photographic processing apparatus of the present invention at a pH of 10.0 or higher, more preferably at a pH in the range from 10.20 to 11.00, excellent developing performance can be obtained. The developing solutions may further contain other known components which are used for the preparation of developing solutions.

To obtain the above-described pH, various buffers are preferably used. Examples of the buffer include carbonates, phosphates, borates, tetraborates, hydroxybenzoates, glycyl salts, N,N-dimethylglycine salts, Leucine salts, norleucine salts, guanine salts, 3,4-dihydoxyphenylalanine salts, alanine salts, amine buryrates, 2-amino-2-methyl-1,3-propanediol salts, valine salts, proline salts, trishydroxyaminomethane salts, and lysine salts. Carbonates and phosphates are preferred.

The buffers are preferably added to the developing solutions in amounts not less than 0.1 mol/liter, preferably in the range from 0.1 mol/liter to 0.4 mol/liter.

Moreover, the developing solutions may contain various chelating agents for preventing the precipitation of calcium or magnesium or for improving the stability of the solutions. Examples of the chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, trans-cyclohexanediamine tetraacetic acid, 1,2-diaminopropanetetraacetic acid, glycolether diaminetetraacetic acid, ethylenediamine orthohydroxyphenylacetic acid, 2-phosphonobutane-1,2,4-tricarboxylic acid, 1-hydroxyethylidene-1,1-diphosphonic acid, N,N'-bis(2-hydroxybenzyl-)ethylenediamine-N,N'-diacetic acid, and hydroxyethylimino diacetic acid. They may be used in combination of two or more as desired.

The chelating agents are added in such amounts that enable metal ions in the developing solutions to be blocked. For example, they are added in amounts from 0.1 g to 10 g per liter of developing solution.

The developing solutions may also contain arbitrary development accelerators if needed. Examples of the development accelerators include thioether compounds described, for example, in JP-B-SHO37-16,088, JP-B-SHO37-5,987, JP-B-SHO38-7,826, JP-B-SHO44-12,380, JP-B-SHO45-9,019, and U.S. Pat. No. 3,813,247; p-phenylenediamine compounds described, for example, in JP-A-SHO52-49,829 and JP-A-SHO50-15,554; quaternary ammonium salts described, for example, in JP-A-SHO50-137,726, JP-B-SHO44-30,074, JP-A-SHO56-156,826, and JP-A-SHO52-43,429; amine compounds described, for example, in U.S. Pat. Nos. 2,494,903, 3,128,182, 4,230,796, 3,253,919, JP-B-SHO41-11,431, U.S. Pat. Nos. 2,482,546, 2,596,926, and 3,582,346; polyalkyleneoxides described, for example, in JP-B-SHO37-16,088, JP-B-SHO42-25,201, U.S. Pat. No. 3,128,183, JP-B-SHO41-11,431, JP-B-SHO42-23,883, and U.S. Pat. No. 3,532,501; and 1-phenyl-3-pyrazolidones, imidazoles, etc.

The developing solutions preferably contain a brightening agent. Preferable examples of the brightening agent include 4,4'-diamine-2,2'-disulfostilbene compounds. They are used in amounts from 0 to 5 g/liter, and preferably 0.1 to 4 g/liter.

The replenishing amounts of the developing solutions are from 20 to 1,000 ml, preferably from 30 to 300 ml, per $m^2$ of sensitive material.

When the above-described developing solutions are used, the developing time is not particularly limited. They are preferably used for quick processing. Preferably, the developing time is from 10 seconds to 2 minutes, and particularly from 15 seconds to 90 seconds.

In the present invention, bleaching and fixing steps or a bleaching/fixing step are/is provided after the developing step. Bleaching solutions or bleaching/fixing solutions which are used in these steps may contain various types of bleaching agents such as hydrogen peroxide, persulfates, red prussiates, dichromates, iron chloride salts, and iron (III) salts of aminopolycarboxylic acids. Most preferable bleaching agents are iron (III) salts of aminopolycarboxylic acids.

Examples of the particularly preferable aminopolycarboxylic acids include, but are not limited to, EDTA, 1,3-PDTA, diethylenetriaminepentaacetic acid, 1,2-cyclohexanediaminetetraacetic acid, iminodiacetic acid, methyliminodiacetic acid, N-(2-acetamide)iminodiacetic acid, nitrilotriacetic acid, N-(2-carboxyethyl)iminodiacetic acid, N-(2-carboxymethyl)iminodipropionic acid, β-alanine diethylenediamine-N,N'-disuccinic acid, and 1,3-propylenediamine-N,N'-disuccinic acid.

The suitable concentration of the iron (III) complexes in bleaching/fixing solutions is from 0,005 to 2.0 mol/liter, more preferably from 0.01 to 1.00 mol/liter, and particularly preferably from 0.02 to 0.50 mol/liter.

The concentration of the iron (III) complexes in replenishing solutions is preferably from 0,005 to 2 mol/liter, and more preferably from 0.01 to 1.5 mol/liter.

The bleaching solutions, bleaching/fixing solutions, and/or their preceding solutions may contain various compounds as a bleach accelerator. For example, the following compounds are preferably used due to their excellent bleaching power: compounds with a mercapto group or a disulfide bond described in U.S. Pat. No. 3,893,858, German Patent No. 1,290,812, JP-A-SHO53-95,630, and Research Disclosure No. 17,129 (July 1978); thiourea compounds described in JP-B-SHO45-8,506, JP-A-SHO52-20,832, JP-A-SHO53-32,735, and U.S. Pat. No. 3,706,561; and halogen compounds containing, for example, an iodine ion or bromine ion.

The bleaching solutions or bleaching/fixing solutions may contain rehalogenating agents such as bromides (for example, potassium bromide, sodium bromide, and ammonium bromide), chlorides (for example, potassium chloride, sodium chloride, and ammonium chloride), and iodides (for example, ammonium iodide). If necessary, corrosion inhibitors may also be added which include one or more inorganic acids, organic acids and their alkali metal salts or ammonium salts having pH buffering ability such as borax, sodium metaborate, acetic acid, sodium acetate, sodium carbonate, potassium carbonate, phosphorous acid, phosphoric acid, sodium phosphate, citric acid, sodium citrate, and tartaric acid; ammonium nitrate, and guanidine.

The bleaching solutions and bleaching/fixing solutions may further contain a variety of brightening agents, antifoam agents, surfactants, and organic solvents such as polyvinylpyrrolidone and methanol.

Fixing agents which are used in the bleaching/fixing solutions or fixing solutions are known in the art, i.e., thiosulfates such as sodium thiosulfate and ammonium thiosulfate; thiocyanates such as sodium thiocyanate and ammonium thiocyanate; thioether compounds such as ethylene bisthioglycolic acid and 3,6-dithia-1,8-octanediol; and thiourea compounds, which are water-soluble silver halide dissolving agents. They are used singly or in combination of two or more. Moreover, special bleaching/fixing solutions comprising a combination of one of the fixing agents described in JP-A-SHO55-155,354 and a large amount of a halide such as potassium iodide can be used. Among the thiosulfates, ammonium thiosulfate is preferred. The fixing agents are preferably used in amounts from 0.3 to 2 mols, more preferably from 0.5 to 1.0 mol per liter of bleaching/fixing solution or fixing solution.

The bleaching/fixing solutions and fixing solutions preferably contain sulfite ion-releasing compounds such as sulfites (for example, sodium sulfite, potassium sulfite, or ammonium sulfite), bisulfites (for example, ammonium bisulfite, sodium bisulfite, and potassium bisulfite), or metabisulfites (such as potassium metabisulfite, sodium metabisulfite, and ammonium metabisulfite) as preservatives. These compounds are preferably present at a concentration in the range from about 0.002 to 0.05 mol/liter and preferably from 0.04 to 0.40 mol/liter as a concentration of the sulfite ion.

As the preservatives for the bleaching/fixing solutions and fixing solutions, sulfites are generally used. Other substances such as ascorbic acid, carbonyl bisulfurous adducts, or carbonyl compounds may also be used. Benzenesulfinic acids are effective, too. In addition, the bleaching/fixing solutions and fixing solutions may contain buffers, brightening agents, chelating agents, antifoam agents, and mildewproofing agents, if desired.

Preferably, the bleaching/fixing solutions and fixing solutions have a pH in the range from 3 to 10, and more preferably from 4 to 9.

After desilverizing has been carried out in the fixing step and the bleaching/fixing step, etc., a washing step or a stabilizing step, or both, are performed, in which the aforementioned solution containing nitrogen dioxide is particularly preferred. The concentration of nitrogen dioxide is preferably from 1 to 100 pm, and more preferably as much as 2 to 50 ppm.

The replenishing amount of the solutions used in the washing step or in the stabilizing step may be arbitrarily determined. It is generally as much as 50 ml to 5 liters per $m^2$ of sensitive material. In order to obtain more remarkable effects of the present invention, low levels of replenishing in which 1.0 to 20 times, preferably 2 to 10 times, as much as the amount of carrying-over from the preceding tank are preferred. Therefore, assuming that the carrying-over amount from the preceding tank is generally about 50 ml per $m^2$ of sensitive material, the actual replenishing amount is about 50 to 1,000 ml.

In the washing solutions or stabilizing solutions, thiosulfates are contained in amounts of not less than $1\times10^{-4}$ mol/liter, preferably from $1\times10^{-3}$ to 0.5 mol/liter, and more preferably from $5\times10^{-3}$ to 0.1 mol/liter. The thiosulfates may be added directly to the solutions or alternatively the thiosulfates may be contained in the preceding fixing solution or bleaching/fixing solution so as to be carried over by the sensitive material.

When the washing solution and stabilizing solution contained in tanks stay for a week—for 2 months on average, their effects are more prominent. The average period of stay is the average period of time for which the solution stays in the tank. It is equivalent to the number of days needed for supplementing the replenishing solution in amounts equivalent to the amounts of solution contained in the tank. The term "amounts of solution contained in the tank" referred to herein means total amounts if there are a plurality of tanks for washing solutions and stabilizing solutions. In order to avoid the degradation of overall photographic characteristics, average periods of stay should not be too long. For example, in excess of 2 months, photographic characteristics are difficult to maintain.

When the washing solution and/or stabilizing solution contain(s) chlorine dioxide, the average period of stay of from 1 week to 2 months, particularly 10 days to 1 month, can provide the most prominent effect in terms of delayed precipice formation due to the sulfuration of solution.

Replenishing may be performed continuously or intermittently. The solutions which have been used in the washing and/or stabilizing steps may be used in their preceding steps. For example, using a multi-stage counterflow system, over-flows of washing solution and stabilizing solution are introduced to their preceding bleaching/fixing tank or fixing tank and a concentrated solution is replenished to the bleaching/fixing tank, the amounts of waste solutions can be reduced.

The amount of washing solution used in the washing step or the amount of stabilizing solution in the stabilizing step can be determined in a wide variety of ranges depending on the characteristics (attributed, for example, to the materials used including couplers) of the sensitive materials (for example, color film and printing paper), use, temperature of the solutions, the number of washing tanks (number of stages), the type of replenishing system such as counter or following current and on other various conditions. Generally speaking, the number of stages in the multi-stage counter-flow system is preferably from 2 to 6, and particularly preferably from 2 to 4.

To prevent the propagation of bacteria in the washing solution or stabilizing solution, the method described in JP-A-SHO62-288,838 is remarkably effective which uses water containing reduced amounts of calcium and magnesium ions. Moreover, the washing solution may optionally contain a surfactant for easy water removal and a chelating agent typified by EDTA for softening hard water.

After the above-described washing step, or in the absence of the washing step, the photographic materials undergo a stabilizing step. The stabilizing solutions contain compounds having image-stabilizing abilities. Such compounds include aldehyde compounds typified by formalin; aldehyde-releasing compounds including N-methylolazoles described in Japanese Patent Application No. HEI3-318,644 such as hexamethylenetetramlne and N-methylolpyrazole; and azolylmethylamines including those described in JP-A-HEI4-313,753 such as N,N'-bis(1,2,4-triazol-1-yl)piperazine. To adjust the pH of the surface of film in a suitable range for stabilizing the dyes, buffers and ammonium compounds may be used. Moreover, to prevent the propagation of bacteria in the solutions or to impart mildewproofing properties to the processed sensitive materials, various bactericides and mildewproofing agents may be used as desired.

Furthermore, surfactants, brightening agents and hardening agents may also be added. If the stabilizing step is directly performed without a washing step, any of the methods described in JP-A-SHO57-8,543, JP-A-SHO58-14,834, and JP-A-SHO60-220,345 can be used.

In addition, use of a chelating agent such as 1-hydroxyethylidene-1,1-diphosphonic acid and ethyledediaminetetramethylene phosphonic acid, and magnesium or bismuth compounds is also preferable.

The pH of the solution in the washing step or the stabilizing step is preferably 4 to 10, and more preferably from 5 to 8. The processing time is arbitrarily determined. However, shorter processing time is more preferable. Preferably, the processing time is from 15 to 105 seconds. More preferably, it is from 15 seconds to 1 minute.

The processing agents (components) of the processing solutions may be supplied in a variety of forms. The agents may be supplied in a form of concentrated liquids containing a single compound or a plurality of compounds. Alternatively, the agents may be supplied in the form of powder. Moreover, ready-to-use solutions may be directly supplied and used. Combinations of the concentrated liquids, powders, and ready-to-use solutions are also possible.

In use of the photographic processing apparatus for color photosensitive materials using the preferable processing solutions according to the present invention, processing steps may be combined in different ways.

Examples of combinations of processing steps generally employed are shown in FIGS. 6A to 6G. In FIG. 6A, a film processing section 16 comprises a developing step 120, bleaching step 122, fixing step 124, washing step 126, and a stabilizing step 128, and a printing paper processing section 24 comprises a developing step 130, bleaching/fixing step 132, and a rinsing step (washing step 134). In each processing step, a single or a plurality of processing tanks may be used.

Alternatively, as shown in FIG. 6B, the washing step 126 in the film processing section 16 may be commonly used by the rinsing step of the printing paper processing section 24. Alternatively, as shown in FIG. 6C, the washing step 126 may be omitted, and the stabilizing step 128 may be commonly shared by a film processing section 16A and a printing section 24A, wherein the film processing section 16A comprises a developing step 120, bleaching step 122, fixing step 124, and a stabilizing step 128.

Alternatively, as shown in FIG. 6D, a printing processing section 24B may comprise a developing step 130, bleaching step 136, fixing step 124, and a washing step 126, of which the fixing step 124 and the washing step 126 are commonly shared with the film processing section 16. Alternatively, as shown in FIGS. 6E and 6F, a film processing section 16B may comprise a developing step 120, bleaching/fixing step 138, and a stabilizing step 128; and a printing paper processing section 24C may comprise a developing step 130, bleaching/fixing step 132, and a stabilizing step 128, in which the stabilizing step 128 is commonly shared (see FIG. 6E), or the bleaching/fixing step 138 and the stabilizing step 128 are shared by the film processing section 16B and the paper-processing section 24C (see FIG. 6F).

Alternatively, a film processing section 16C may comprise a developing step 120, bleaching/fixing step 138, washing step 126, and a stabilizing step 128; and the washing step 126 may be shared by the film processing section 16*c* and the print paper processing section 24. The manner of combining the respective steps is not limited to the above as long as color photographic film and color printing paper are suitably processed.

Next, a description will be made of color photographic film among the photosensitive materials which can be used in the photographic processing apparatus of the present invention.

Although any type of color photographic film can be processed using the photographic processing apparatus of the present invention, the patent publications listed in Tables 1 to 5 below, particularly European Patent No. 355,660 A2 (Japanese Patent Application No. HEI1-107,011) are referred to for preferable silver halide emulsions and other materials (additives, etc.), photographic constituting layers (order of layers, etc.), and methods and additives usable in processing the light-sensitive materials.

TABLE 1

| Photographic constituents, and the like | JP-A-SHO62-215272 | JP-A-HEI2-33144 | EPO No. 355,660A2 |
|---|---|---|---|
| Silver halide emulsions | Page 10, right upper column, line 6 to page 12, left lower column, line 5, and page 12, right lower column, 4th line from the last line to page 13, left upper column, line 17 | Page 28, right upper column, line 16 to page 29, right lower column, line 11, and page 30, line 2 to line 5 | Page 45, line 53 to page 47, line 3, and page 47, line 20 to line 22 |
| Silver halide solvents | Page 12, left lower column, line 6 to line 14, and page 13, left upper column, 3rd line from the last line to page 18, left lower column, the last line | — | — |
| Chemical sensitizers | Page 12, left lower column, 3rd line from the last line to right lower column, 5th line from the last line, and page 18, right lower column, line 1 to page 22, right upper column, 9th line from the last line | Page 29, right lower column, line 12 to line 13 | Page 47, line 4 to line 9 |
| Spectral sensitizers (Spectral sensitizing (methods) | Page 22, right upper column, 8th line from the last line to page 38, the last line | Page 30, left upper column, line 1 to line 13 | Page 47, line 10 to line 15 |
| Emulsion stabilizers | Page 39, left upper column, line 1 to page 73, right upper column, the last line | Page 30, left upper column, line 14 to right upper column, line 1 | Page 47, line 16 to line 19 |
| Development accelerators | Page 72, left lower column, line 1 to page 91, right upper column, line 3 | — | — |

TABLE 2

| Photographic constituents, and the like | JP-A-SHO62-215272 | JP-A-HEI2-33144 | EPO No. 355,660A2 |
|---|---|---|---|
| Color couplers (Cyan, magenta, yellow couplers) | Page 91, right upper column, line 4 to page 121, left upper column, line 6 | Page 3, right upper column, line 14 to page 18, left upper column, the last line and page 30, right upper column, line 6 to page 35, right lower column, line 11 | Page 4, line 15 to line 27, page 5, line 30 to page 28, the last line, page 45, line 29 to line 31, and page 47, line 23 to page 63, line 50 |
| Color increasing agents | Page 121, left upper column, line 7 to page 121, right upper column, line 1 | — | — |
| UV absorbers | Page 125, right upper column, line 2 to page 127, left lower column, the last line | Page 37, right upper column, line 14 to page 38, left upper column, line 11 | Page 65, line 22 to line 31 |
| Anti-fading agents (Image stabilizers) | Page 127, right lower column, line 1 to page 137, left | Page 36, right upper column, line 12 to page 37, left upper | Page 4, line 30 to page 5, line 23, page 29, line 1 to |

TABLE 2-continued

| Photographic constituents, and the like | JP-A-SHO62-215272 | JP-A-HEI2-33144 | EPO No. 355,660A2 |
|---|---|---|---|
| | lower column, the last line | column, line 19 | page 45, line 25, page 45, line 33 to line 40, and page 65, line 2 to line 21 |
| High B.P. and/or low B.P. organic solvents | Page 137, left lower column, line 9 to page 144, right lower column, the last line | Page 35, right lower column, line 14 to page 36, left lower column, 4th line from the last line | Page 64, line 1 to line 51 |
| Method of dispersing photographic additives | Page 144, left lower column, line 1 to page 146, right upper column, line 7 | Page 27, right lower column, line 10 to page 28, left upper column, the last line and page 35, right lower column, line 12, to page 36 right upper column, line 7 | Page 65, line 51 to page 64, line 56 |

TABLE 3

| Photographic constituents, and the like | JP-A-SHO62-215272 | JP-A-HEI2-33144 | EPO No. 355,660A2 |
|---|---|---|---|
| Hardening agents | Page 146, upper column, line 8 to page 155, left lower column, line 4 | — | — |
| Developing agent precursors | Page 155, left lower column, line 5 to page 155, right lower column, line 2 | — | — |
| Development inhibitor releasing compounds | Page 155, right lower column, line 3 to line 9 | — | — |
| Supports | Page 155, right lower column, line 19 to page 156, left upper column, line 14 | Page 36, right upper column, line 18 to page 39, left upper column, line 3 | Page 66, line 29 to page 67, line 13 |
| Constitution of sensitive material layers | Page 156, left upper column, line 15 to page 156, lower column, line 14 | Page 28, right upper column , line 1 to line 15 | Page 45, line 41 to line 52 |
| Dyes | Page 156, right lower column, line 15 to page 184, right lower column, the last line | Page 38, left upper column, line 12 to right upper column, line 7 | Page 66, line 18 to line 22 |
| Color mixing inhibitors | Page 185, left upper column, line 1 to page 188, right lower column, line 3 | Page 36, right upper column, line 8 to line 11 | Page 64, line 57 to page 65, line 1 |
| Gradation adjusting agents | Page 188, right lower column, line 4 to line 8 | — | — |

TABLE 4

| Photographic constituents, and the like | JP-A-SHO62-215272 | JP-A-HEI2-33144 | EPO No. 355,660A2 |
|---|---|---|---|
| Antistain agents | Page 188, right lower column, line 9 to page 193, right lower column, line 10 | Page 37, left upper column, the last line to right lower column, line 13 | Page 65, line 32 to page 66, line 17 |
| Surfactants | Page 201, left lower | Page 18, right upper | — |

TABLE 4-continued

| Photographic constituents, and the like | JP-A-SHO62-215272 | JP-A-HEI2-33144 | EPO No. 355,660A2 |
|---|---|---|---|
| | column, line 1 to page 210, right upper column, the last line | column, line 1 to page 24, right lower column, the last line, and page 27, left lower column, 10th line from the last line to right lower column, line 9 | |
| Fluorine-containing compounds (For use as antistatic agents, coating aids, lubricants, antiadhesive agents, etc.) | Page 210, left lower column, line 1 to page 222, left lower column, line 5 | Page 25, left upper column, line 1 to page 27, right upper column, line 9 | — |
| Binders (Hydrophilic colloids) | Page 222, left lower column, line 6 to page 225, left upper column, the last line | Page 38, right upper column, line 8 to line 18 | Page 66, line 23 to line 28 |
| Thickeners | Page 225, right upper column, line 1 to page 227, right upper column, line 2 | — | — |
| Antistatic agents | Page 227, right upper column, line 3 to page 230, left upper column, line 1 | — | — |

TABLE 5

| Photographic constituents and the like | JP-A-SHO62-215272 | JP-A-HEI2-33144 | EPO No. 355,660A2 |
|---|---|---|---|
| Polymer latex | Page 230, left upper column, line 2 to page 239, the last line | — | — |
| Matte agents | Page 240, left upper column, line 1 to page 240, right upper column, the last line | — | — |
| Photographic processing methods (processing steps, additives, etc) | Page 3, right upper column, line 7 to page 10, right upper column, line 5 | Page 39, left upper column, line 4 to page 42, left upper column, the last line | Page 67, line 14 to page 69, line 28 |

Note: The cited portions of JP-A-62-215272 include portions which have been amended by an amendment dated March 16, 1987, which is appended to the end of the published specification. Further, it is preferable to use, as yellow couplers among the above mentioned color couplers, so-called yellow couplers of a short wavelength type, which are disclosed in JP-A-63-231451, JP-A-63-123047, JP-A-63-241547, JP-A-1-173499, JP-A-1-213648 and JP-A-1-250944.

In the photosensitive materials, color photographic films to which the present invention is preferably applied are prepared using emulsions of a variety of silver halides including silver iodobromide, silver iodochloride, silver iodochlorobromide, silver chlorobromide, silver bromide, and silver chloride. It is particularly preferred that the films include at least one layer of an emulsion containing silver halide particles not less than 90 mol % of which is silver chloride. More preferably, the emulsion contains from 95 to 99.9 mol % or more. Particularly preferably, all the emulsion layers contain chlorobromide emulsions composed of 98 to 99.9 mol % of silver chloride. The amount of silver used for coating the films is not particularly limited, but it is preferably from 0.2 to 15 g/m$^2$, and more preferably from 0.4 to 0.5 g/m$^2$.

When the photographic films are color films, they may contain a variety of couplers. Detailed information of such couplers is shown in Table 2.

Regarding cyan couplers, preferable examples thereof include diphenylimidazole cyan couplers described in JP-A-HEI2-33,144, 3-hydroxypyridine cyan couplers described in European Patent No. 0,333,185 A2 (particularly, couplers obtained by incorporating leaving chlorine into the 4-equivalent couplers of coupler (42) listed in this publication and converting them into 2-equivalent couplers; coupler (6); and coupler (9) being preferred) and cyclic active methylene cyan couplers described in JP-A-SHO64-32,260 (particularly, coupler Nos. 3, 8, and 34 are preferred).

In an attempt to improve the sharpness of images on photographic film, it is preferable that decolorable dyes (particularly oxonole dyes) which have undergone the processing described in European Patent No. 0,337,490 A2, pages 27–76 are incorporated into hydrophilic colloidal layers so that the optical reflective concentration of the film at 680 nm is equal to or greater than 0.70. Alternatively, it is also preferable that waterproof resin layers of the support contain titanium dioxide particles which have been surface-treated with dihydric or tetrahydric alcohols (such as trimethylolethane) in amounts not less than 12% by weight (more preferably not less than 14% by weight).

Color films preferably contain compounds for improving dye-image storability disclosed, for example, in European Patent No. 0,277,589 A2 along with couplers, such as preferably pyrazoloazole couplers.

That is, combined or single use of the following compounds (F) and/or (G) is preferable for preventing generation of stain and other adverse side effects causable by the formation of color-developing dyes as a result of the reaction of couplers and color developers or their oxidized products left in the film, the reaction being causable during storage after processing.

The compound (F): It can be chemically bound to a primary developer of aromatic amine remaining after the color developing process so as to produce a chemically inert and substantially colorless compound.

The compound (G): It can be chemically bound to an oxidized primary color developer of aromatic amine remaining after the color developing process so as to produce a chemically inert and substantially colorless compound.

Preferably, the photographic film contains mildewproofing agents described, for example, in JP-A-SHO63-271,247 to prevent propagation of mold and bacteria in hydrophilic colloidal layers, causing degradation of photographic images.

The thickness of the photographic film (color film), excluding that of the support, is preferably equal to or less than 25 μm in a dry state. When such film is processed using the photographic processing apparatus of the present invention, excellent processing effects can be obtained. The thickness of the support is preferably from 5 to 20 μm, and more preferably from 6 to 17 μm. Although the thickness can be reduced by diminishing the amounts of gelatin, silver, oils, couplers, etc, the most preferable way to achieve it is to reduce the gelatin amount. The film thickness is measured by a routine method after allowing a sample to stand at 25° C. and 60 RH % for 2 weeks.

Photographic film preferably has a swelling degree from 1.5 to 4.0 to improve stain and image storability. If it is in the range from 1.5 to 3.0, more enhanced effects can be obtained. The degree of swelling is expressed by the value obtained by dividing the thickness of a photographic layer after soaking it in 33° C. distilled water for 2 minutes by the thickness of the photographic layer in a dry state.

The photographic layer comprises at least one sensitive silver halide emulsion layer and hydrophilic colloidal layers with water-absorbing capacity in contact with the emulsion layer, the emulsion layer and the hydrophilic colloidal layer being superposed on one another. A backing layer, which is provided opposite to the photosensitive layer(s) with respect to a support is not a photographic layer. The photographic layer is generally composed of a plurality of layers which take part in the formation of photographic images, including an intermediate layer, a filter layer, an antihalation layer, and a protective layer.

In order to obtain a degree of swelling in the above ranges, any method can be used. For example, the amount or kind of gelatin and hardeners, drying conditions, and other time-dependent conditions after coating of a photographic layer may be changed to regulate the swelling. In the photographic layer, gelatin is preferably used. Hydrophilic colloidal substances than gelatin, however, may be used as well, which include gelatin derivatives, graft polymers of gelatin and other polymers, proteins such as albumin and casein, cellulose derivatives such as hydroxyethylcellulose, carboxymethylcellulose, and cellulose sulfates, saccharide derivatives such as sodium alginate and starch derivatives, a wide variety of synthetic hydrophilic polymers such as homopolymers and copolymers including polyvinyl alcohol, polyvinyl alcohol which partially has acetal, poly-N-vinylpyrrolidone, polyacrylic acid, polymethacrylic acid, polyacrylic amide, polyvinyl imidazole, and polyvinyl pyrazole.

The gelatin may be acid-treated gelatin as well as lime-treated gelatin. Gelatin hydrolyzates and enzyme-decomposed products of gelatin may also be used. As the gelatin derivatives, those obtained by reacting gelatin with, for example, acid halides, acid anhydrides, isocyanates, bromoacetic acid, alkanesultones, vinylsulfonic amides, maleic imides, polyalkylene oxides and epoxy compounds may be used.

The above-mentioned graft polymers of gelatin include those obtained by graft polymerization of gelatin and a homopolymer or copolymer of a vinyl monomer such as acrylic acid, methacrylic acid, and derivatives of acrylic acid and methacrylic acid (such as esters and amides), acrylonitrile, and styrene. It is preferred that polymers with a certain level of miscibility with gelatin be used. Examples of the polymers include acrylic acid, methacrylic acid, acrylic amide, methacrylic amide, hydroxyacrylic methacrylate. Examples of them are found, for example, in U.S. Pat. Nos. 2,763,625, 2,831,767 and 2,956,884. Typical examples of synthetic hydrophilic polymers are found, for example, in German Patent Publication (OLS) No. 2,312,708, U.S. Pat. Nos. 3,620,751, 3,879,205, and JP-B-SHO43-7,561.

Examples of the hardeners include chromium salts (such as chromium alum and chromium acetate), aldehydes (such as formaldehyde, glyoxal, and glutaraldehyde), N-methylol compounds (such as dimethylol urea and methylol dimethylhydantoin), dioxane derivatives (such as 2,3-dihydroxydioxane), active vinyl compounds (such as 1,3,5--triacryloyl-hexahydro-s-triazine and bis(vinylsulfonyl)methylether, N,N'-methylenebis-[(β-vinylsulfonyl)propionamide], active halogen compounds (such as 2,4-dichloro-6-hydroxy-s-triazine), mucohalogenic acids (such as mucochloric acid and mucophenoxychloric acid), isooxazoles, dialdehyde starches, and 2-chloro-6-hydroxytriazinyl gelatin. They are used singly or in combination.

Particularly preferable hardeners are aldehydes, active vinyl compounds, and active halogen compounds.

The support used for preparing color photographic film may be a white polyester support for improved displays, or it may be one in which a layer containing white pigments is provided on the support on the side having a silver halide emulsion layer. In order to further improve sharpness, an antihalation layer is preferably provided by coating onto the support on the side of silver halide emulsion layer or on the back side. Especially, the transmission density of the support is preferably set to fall in the range from 0.35 to 0.8 for allowing displays to be appreciated by reflected light or transmitted light.

The photographic film can be exposed with visible light. Alternatively, it may be exposed with infrared rays. Exposure may be performed under either low illumination intensity or high illumination intensity for short time. Especially in the latter case, a laser scanning exposure system is recommended in which the exposure time is shorter than $10^{-4}$ seconds per pixel.

In the step of exposure, a hand-stop filter described in U.S. Pat. No. 4,880,726 is preferably used. This removes light amalgamation to significantly improve color reproduction.

The above and other objects, features and advantages of the present invention will become apparent from the following description and the appended claims, taken in conjunction with the accompanying drawings in which preferred embodiments of the present invention are shown by way of illustrative example.

BRIEF DESCRIPTION OF THE DRAWINGS

The invention will now be described with reference to the accompanying drawings wherein.

DESCRIPTION OF THE PREFERRED EMBODIMENTS

Figure 1:
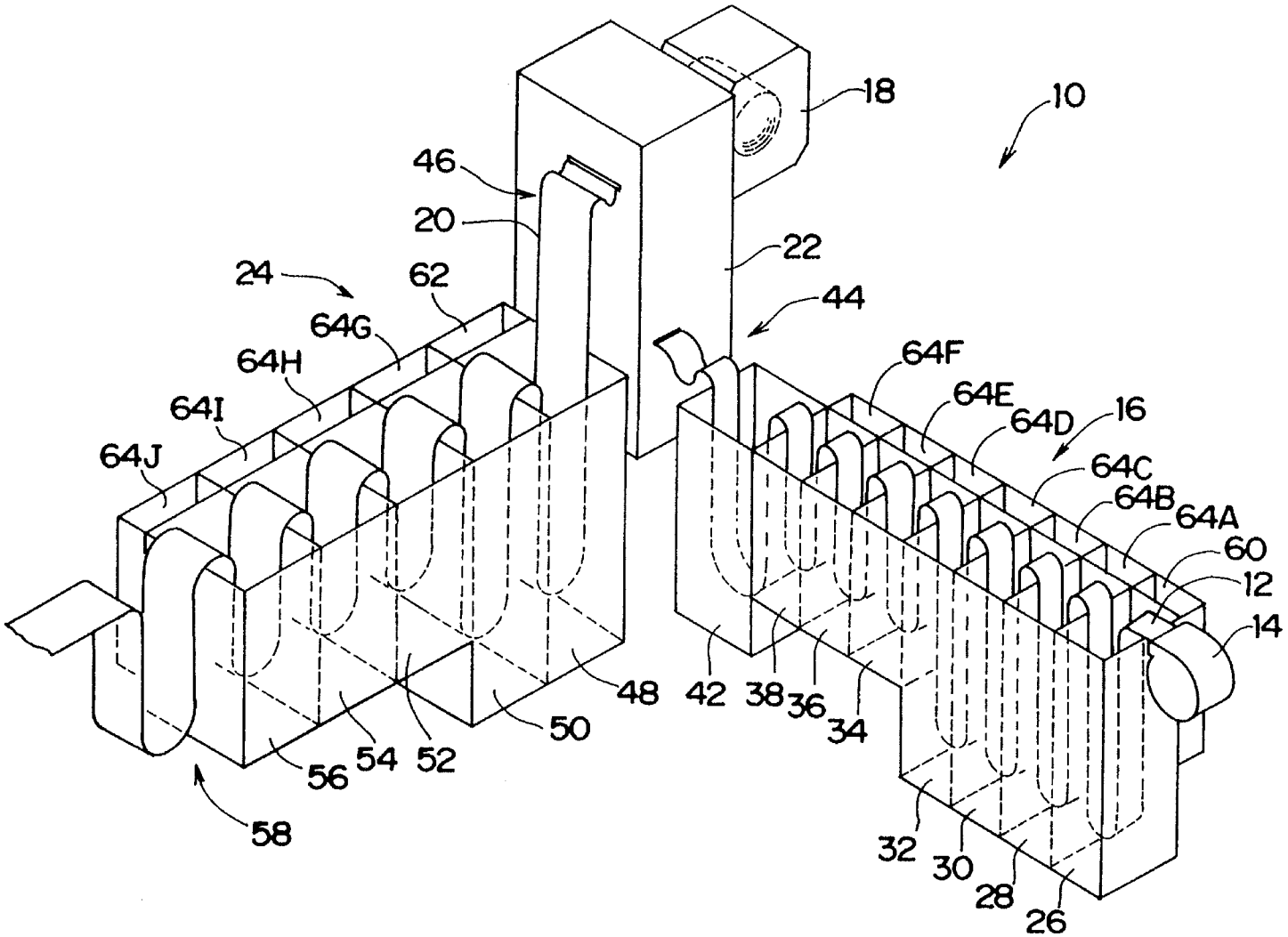
FIG. 1 is a schematic perspective view showing the structure of a photographic processing apparatus to which an embodiment of the present invention can be applied.

FIG. 1 shows a photographic processing apparatus 10 to which an embodiment of the present invention can be applied. The photographic processing apparatus 10 includes a film processing section 16, an image exposure section 22, and a printing paper processing section 24, which are integrally housed in an unillustrated casing. In the film processing section 16, for example, a negative color photographic film (hereinafter referred to as "negative film 12") on which images have been photographed is pulled out from a cartridge 14 and developed. In the image exposure section 22, a rolled color printing paper (hereinafter referred to as "printing paper 20") is pulled out from a magazine 18 and is subjected to exposure according to images recorded on the developed negative film 12. In the printing paper processing section 24, the printing paper 20 which has undergone the exposure is subjected to a developing process.

In FIG. 1, the film processing section 16 and the printing paper processing section 24 are illustrated as being separated to show the internal structure of the photographic processing apparatus 10.

In the film processing section 16, a developing tank 26 for storing a developing solution, a bleaching tank 28 for storing a bleaching solution, first and second fixing tanks 30 and 32 for respectively storing a fixing solution, a wash tank 34 for storing washing water, and first and second stabilizing bath tanks 36 and 38 for respectively storing a stabilizer are successively arranged. A drying compartment 42 and a reservoir section 44 are provided on the downstream side of the second stabilizing bath tank 38.

The negative film 12 pulled out of the cartridge 14 is conveyed by an unillustrated conveying means to successively pass through the developing tank 26, the bleaching tank 28, the first fixing tank 30, the second fixing tank 32, the wash tank 34, the first stabilizing bath tank 36 and the second stabilizing bath tank 38, so that the negative film 12 is processed by the developing solution, the bleaching solution, the fixing solution, the washing water, and the stabilizer. After the processing, the negative film 12 is conveyed to the drying compartment 42 in which dry air produced by a heater and a drying fan (both are not illustrated) is jetted to the negative film 12 to dry it. The negative film 12 is thereafter fed to the reservoir section 44.

The negative film 12 which has undergone the developing process is pulled into the image exposure section 22 from the reservoir section 44 while the printing paper 20 is pulled into the image exposure section 22 from the magazine 18 so as to successively print on the printing paper 20 images recorded on the negative film 12. The image exposure section 22 can employ various exposing methods such as a slit exposing method in which images recorded on the negative film 12 is printed on the printing paper 20 by exposure while the negative film 12 and the printing paper 20 are conveyed at predetermined speeds, respectively, and a method in which images recorded on the negative film 12 are read by an image detecting means, and the read images are printed on the printing paper 20 by a laser beam or the like which scans the printing paper. After the completion of the exposure, the printing paper 20 is fed out to a reservoir section 46 provided between the image exposure section 22 and the printing paper processing section 24.

In the printing paper processing section 24, a developing tank 48 for storing a developing solution for the printing paper 20, a bleaching/fixing tank 50 for storing a bleaching/fixing solution, and first, second and third rinsing tanks 52, 54 and 56 for respectively storing a rinsing solution are arranged. A drying compartment 58 is provided on the downstream side of the third rinsing tank 56 in the conveying direction of the printing paper. The printing paper 20 which has been fed out to the reservoir section 46 after exposure is conveyed by an unillustrated conveying means to the printing paper processing section 24 in which the printing paper 20 is successively passed through the developing tank 48, the bleaching/fixing tank 50, the first rinsing tank 52, the second rinsing tank 54 and the third rinsing tank 56, so that the printing paper 20 is processed by the developing solution, the bleaching/fixing solution, and the rinsing solution. After the processing by the processing solutions, the printing paper 20 is conveyed through the drying compartment 58 in which dry air produced by a heater and a drying fan (both unillustrated) is jetted to the printing paper 20 to dry it.

After the drying process, the printing paper 20 is cut, for example, in a frame-by-frame fashion, and is discharged as photographic prints.

The processing solutions stored in the processing tanks of the film processing section 16 and the printing paper processing section 24 are circulated by a circulating means so that they are uniformly stirred. Also, the processing solutions are heated by a heating means such that the temperatures thereof are maintained within predetermined temperature ranges.

Figure 2:
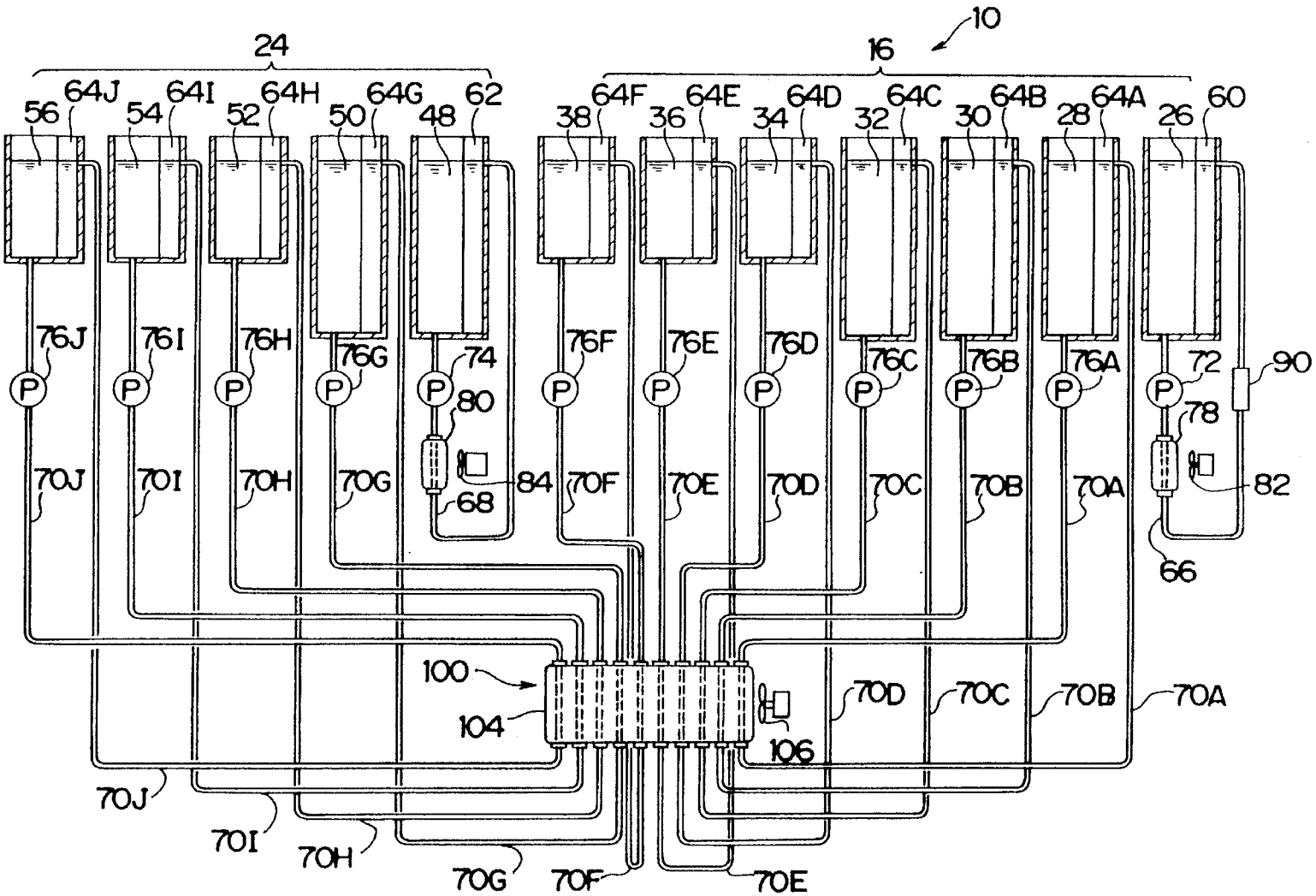
FIG. 2 is a schematic diagram of piping which shows circulation of processing solutions of the photographic processing apparatus according to the embodiment.

FIG. 2 schematically shows the piping of the photographic processing apparatus 10. The piping is provided to circulate and heat the processing solutions in the processing tanks. In the photographic printing apparatus 10, subtanks 60 and 62 are provided in the vicinity of the development tank 26 of the film processing section 16 and the development tank 48 of the printing paper processing section 24, respectively. Also, subtanks 64A–64J are provided in the vicinity of the bleaching tank 28, the first fixing tank 30, the second fixing tank 32, the wash tank 34, the first stabilizing bath tank 36 and the second stabilizing bath tank 38 of the film processing section 16, and the bleaching/fixing tank 50, the first rinsing tank 52, the second rinsing tank 54 and the third rinsing tank 56 of the printing paper processing section 24. Hereinafter, these tanks are referred to as "processing tanks" when they are generally referred.

The processing tanks are separated from the subtanks 60, 62 and 64A–64J by unillustrated filters such that the processing solutions can pass through the filters. One end of pipes 66, 68 and 70A–70J is opened to the bottoms of the processing tanks while the other end of the pipes 66, 68 and 70A–70J is opened to the upper portions of the subtanks 60, 62 and 64A–64J.

Circulating pumps 72, 74 and 76A–76J are provided in the middle of the pipes 66, 68 and 70A–70J, respectively. When the circulating pumps 72, 74 and 76A–76J are operated, the processing solutions are sucked from the processing tanks by the circulating pumps 72, 74 and 76A–76J and are returned to the subtanks 60, 62 and 64A–64J, whereby circulation of the processing solutions and agitation of the processing solutions in the processing tanks are carried out. When the processing solutions flow from the subtanks 60, 62 and 64A–64J to corresponding processing tanks, floating substances and the like are filtered off by the unillustrated filters.

Cartridge heaters 78 and 80 are attached to the pipe 66 communicating with the developing tank 26 of the film processing section 16 and the pipe 68 communicating with the developing tank 48 of the printing paper processing section 24 on the downstream sides of the circulating pumps 72 and 74, respectively, and cooling fans 82 and 84 are provided in the vicinity of the cartridge heaters 78 and 80.

Figure 4:
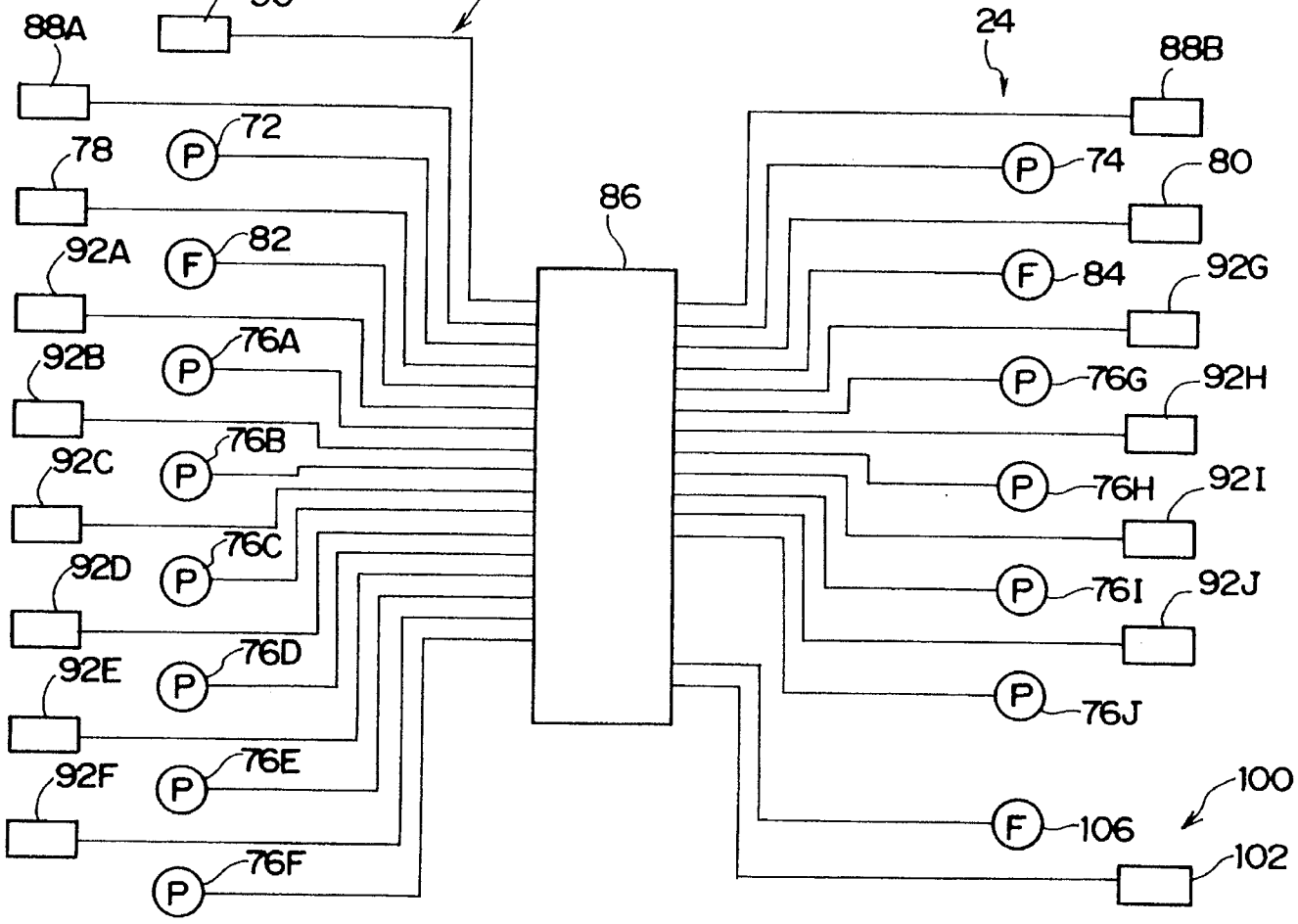
FIG. 4 is a schematic block diagram of a control section which controls the temperatures of the processing solutions of the photographic processing apparatus.

As shown in FIG. 4, the circulating pumps 72 and 74, the cartridge heaters 78 and 80, and the cooling fans 82 and 84 are connected to a control unit 86. Temperature sensors 88A and 88B attached to the subtanks 60 and 62 are also connected to the control unit 86.

The control unit 86 operates the circulating pumps 72 and 74 and the cartridge heaters 78 and 80 to circulate the developing solutions while heating them, and operates the cooling fans 82 and 84 when necessary, so that the developing solutions are respectively maintained at predetermined temperatures.

A flow meter 90 is provided in the middle of the pipe 66 communicating with the developing tank 26 of the film processing section 16 and is connected to the control unit 86. The circulating pump 72 is controlled by means of the flow meter 90 such that the circulation, per a unit time, of the developing solution in the developing tank 26 is essential constant. This operation prevents the occurrence of developer streaks of the negative film 12 which would occur when the circulation of the developing solution in the developing tank 26 of the film processing section 16 is too large or too small.

As shown in FIG. 2, the pipes 70A–70J communicating with the bleaching tank 28 through the second stabilizing bath tank 38 of the film processing section 16 and the bleaching/fixing tank 50 through the third rinsing tank 56 of the printing paper processing section 24 are coupled together at their intermediate portions by a metal block 104 of a cast heater 100. The metal block 104 has a high thermal conductivity.

Figure 3:
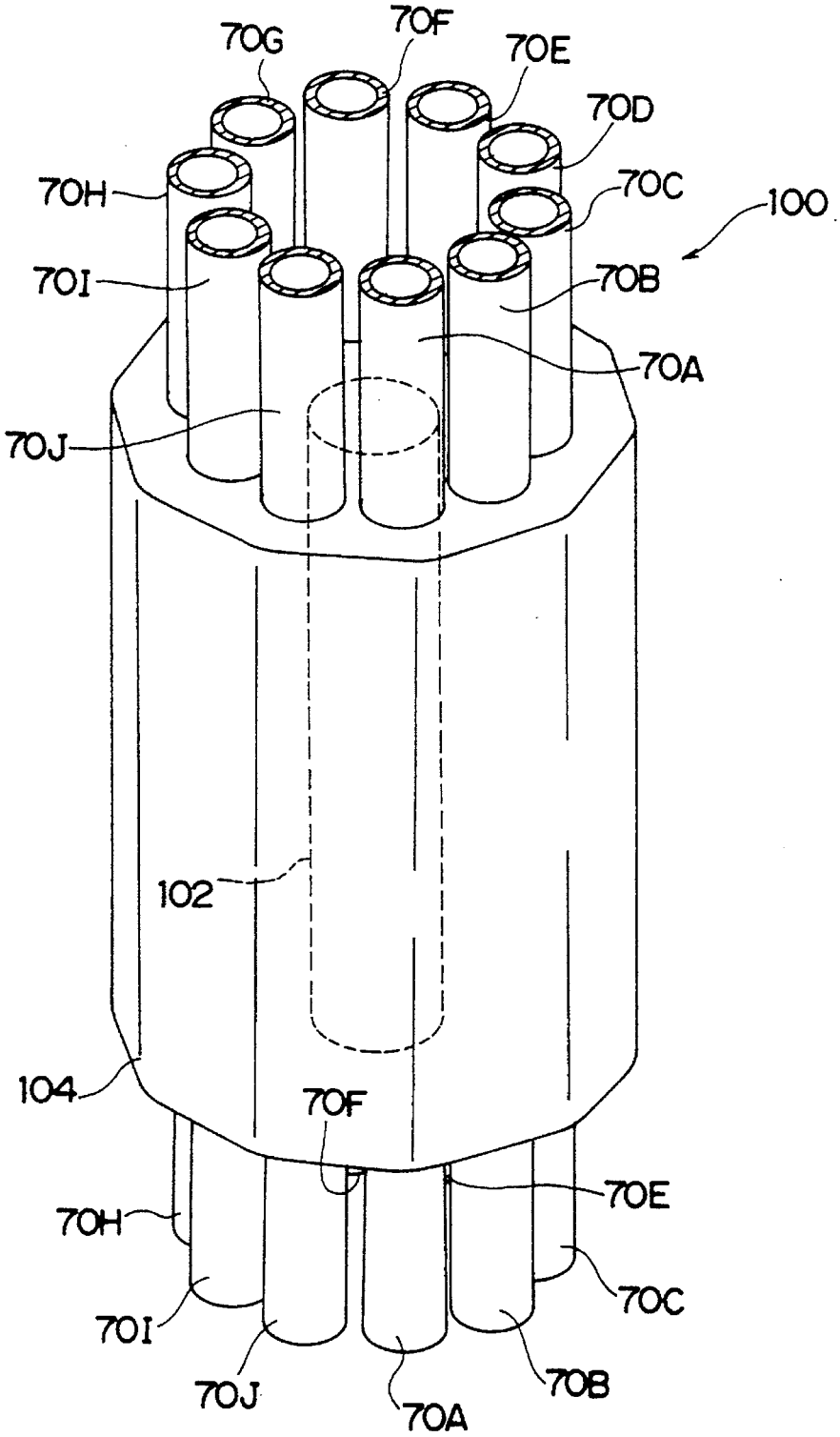
FIG. 3 is a schematic perspective view showing an example of a heat source used in the embodiment.

As shown in FIG. 3, the metal block 104 of the cast heater 100 has a prismatic shape, and a heater unit 102 is arranged at the center of the metal block 104. The pipes 70A–70J penetrate the metal block 104 such that they are disposed at the same distances from the heater unit 102 and they are separated from each other by a uniform distance. The metal block 104 integrally couples parts of the pipes 70A–70J.

As shown in FIG. 4, the circulating pumps 76A–76J and the cast heater 100 are connected to the control unit 86. Also, temperature sensors 92A–92J provided in the subtanks 64A–64J are connected to the control unit 86.

The control unit 86 operates the circulating pumps 76A–76J, and supplies electricity to the heater unit 102 of the cast heater 100 to heat the processing solutions which pass through the pipes 70A–70J. Also, a cooling fan 106 for cooling the cast heater 100 is connected to the control unit 86. When the temperature of any of the processing solutions exceeds a predetermined temperature, the cooling fan 106 is operated to cool the processing solutions.

The control unit 86 maintains the temperatures of the developing solutions of the film processing section 16 and the printing paper processing section 24 to be in the range of 42±0.5° C., and maintains the temperatures of the processing solutions in the bleaching tank 28 and the subsequent tanks of the film processing section 16 and the temperatures of the processing solutions in the bleaching/fixing tank 50 and subsequent tanks of the printing paper processing section 24 to be in the range of 38±0.5° C., by means of the cast heater 100.

Specifically, the control unit 86 detects the temperatures of the processing solutions in the processing tanks by means of the temperature sensors 92A–92J. The unit turns off the heater unit 102 when one of the processing solutions heated by the cast heater 100 exceeds the above-described temperature range. The cooling fan 106 is operated when necessary. In the event that none of the processing solutions exceeds a preset temperature even after a predetermined period of time has elapsed, the cooling fan 106 is stopped so that all the processing solutions are maintained within the predetermined temperature range by mutual heat exchange among the processing solutions, and the processing solutions are heated by the heater unit 102 to a degree such that the temperatures of the processing solutions do not exceed the preset temperature. Unillustrated over-heat protectors such as thermostats are provided inside the cartridge heaters 78 and 80 and the cast heater 100 so as to shut off the power when they excessively heat.

The photographic processing apparatus 10 employs a so-called counter-flow system in which the developing tank 26, the bleaching tank 28, the second fixing tank 32, the wash tank 34 and the second stabilizing bath tank 38 are respectively replenished with developing solution, bleaching solution, washing water and stabilizer in accordance with the processing amount of the negative film 12, by an unillustrated replenishing mechanism, and excess part of the fixing solution supplied to the second fixing tank 32 is allowed to flow into the first fixing tank 30 while excess part of the stabilizer supplied to the second stabilizing bath tank 38 is allowed to flow into the first stabilizing bath tank 36. Excessive part of the processing solutions supplied to the developing tank 26, the bleaching tank 28, the first fixing tank 30, the wash tank 34 and the first stabilizing bath tank 36 are drained via unillustrated overflow pipes.

Like the film processing section 16, the printing paper processing section 24 employs a counter-flow system in which the developing tank 48, the bleaching/fixing tank 50 and the third rinsing tank 56 are respectively replenished with replenishing solutions in accordance with the processing amount of the printing paper 20, and excess part of the rinsing solution supplied to the third rinsing tank 56 is allowed to flow into the second rinsing tank 54 while excess part of the rinsing solution supplied to the second rinsing tank 54 is allowed to flow into the first rinsing tank 52. Excessive part of the processing solutions supplied to the developing tank 48, the bleaching/fixing tank 50 and the first rinsing tank 52 are drained via unillustrated overflow pipes.

In the film processing section 16 and the printing paper processing section 24, the replenishment is performed in accordance with the passage of time as well as the replenishment based on the processing amounts of the negative film 12 and the printing paper 20.

Next, the processing steps and the processing solutions used in the photographic processing apparatus 10 will be described. First, in the film processing section 16, the processing steps, the processing times, the temperatures of the processing solutions, the replenishing amounts of the processing solutions, and the capacities of the processing tanks (tank capacities) are set as follows:

| Processing step | Time | Temp. | Replenishing amount | Capacity of tank |
|---|---|---|---|---|
| Development | 90 sec. | 42° C. | 23 ml | 17 liters |
| Bleaching | 40 sec. | 38° C. | 5 ml | 5 liters |
| Fixing (1) | 40 sec. | 38° C. | — | 5 liters |
| Fixing (2) | 40 sec. | 38° C. | 16 ml | 5 liters |
| Washing | 20 sec. | 38° C. | 34 ml | 3 liters |
| Stabilizing (1) | 20 sec. | 38° C. | — | 3 liters |
| Stabilizing (2) | 20 sec. | 38° C. | 20 ml | 3 liters |
| (Drying | 1 min. | 60° C.) | | |

The replenishing amount is shown as an amount per 1.1 m of the negative film 12 having 35 mm width (corresponding to a single strip, i.e. one roll of 24 Ex film).

The stabilizer reversely flows from the second stabilizing bath tank 38 to the first stabilizing bath tank 36. In order to replenish into the first fixing tank 30, a cut-away portion is formed in the upper portion of the bleaching tank 28 and the upper portion of the second fixing tank 32 so that the overflown portions of the replenishing solutions supplied to the bleaching tank 28 and the second fixing tank 32 flow into the first fixing tank 30. The crossover period from the time when the negative film 12 comes out of the processing solution in one of the processing tanks to the time when the negative film 12 enters the processing solution in the downstream processing tank is 6 seconds. This crossover period is included in the processing time of the preceding step. The replenishing solutions were the same as the processing solutions in the tanks.

Next, the compositions of the processing solutions will be described. In general, these processing solutions are the above-described processing solutions which are preferably used in the present invention.

| | (g) |
|---|---|
| Developing solution (color developing solution) | |
| Diethylenetriaminepentaacetic acid | 2.0 |
| 1-Hydroxyethylidene-1,1-diphosphonic acid | 2.0 |
| Sodium sulfite | 3.9 |
| Potassium carbonate | 37.5 |
| Potassium bromide | 1.4 |
| Potassium iodide | 1.3 mg |
| Hydroxylamine sulfate | 2.4 |
| 2-Methyl-4-[N-ethyl-N-(β-hydroxy ethyl)amino]aniline sulfate | 6.0 |
| Total amount after adding water | 1.0 liter |
| pH (adjusted with potassium hydroxide and sulfuric acid) | 10.05 |
| Bleaching solution | |
| 1,3-Diaminopropane iron(III)tetraacetate ammonium.$H_2O$ | 130 |
| Ammonium bromide | 80 |
| Ammonium nitrate | 15 |
| Hydroxyacetic acid | 25 |
| Acetic acid | 40 |
| Total amount after adding water | 1.0 liter |
| pH (adjusted with ammonia water) | 4.4 |
| Fixing solution | |
| Ammonium sulfite | 19 |
| Ammonium thiosulfate solution (700 g/liter) | 280 ml |
| Imidazole | 15 |
| Ethylenediaminetetraacetic acid | 15 |
| Total amount after adding water | 1.0 liter |
| pH (adjusted with ammonia water and acetic acid) | 4.4 |

The fixing solution is stored in the second fixing tank 32. The first fixing tank 30 is filled with a mixture (pH 7.0) serving as a bleaching/fixing solution which is obtained by mixing the above-described bleaching solution and fixing solution at a ratio of 15:85 (ratio by volume).

Washing Water

Tap water was passed through a mixture-bed column filled with an H-type strongly acidic cation exchange resin (Amber light IR-120B, Rohm & Haas Co.) and an OH-type strongly basic anion exchange resin (Amber light IR-400, Rohm & Haas Co.) to make the concentrations of calcium and magnesium ions not more than 3 mg/liter. Subsequently, 20 mg/liter of sodium dichloric isocyanurate and 150 mg/liter of sodium sulfate were added thereto. The pH of the water was adjusted to be within the range of 6.5–7.5.

| Stabilizing solution | (g) |
|---|---|
| Sodium p-toluene sulfonate | 0.03 |
| Polyoxyethylene-p-monononylphenylether (average polymerization degree: 10) | 0.2 |
| Disodium ethylenediaminetetraacetate | 0.05 |
| 1,2,4-Triazole | 1.3 |
| 1,4-Bis(1,2,4-triazole-1-ylmethyl) piperazine | 0.75 |
| Total amount after adding water | 1.0 liter |
| pH | 8.5 |

Next, in the processing steps for the printing paper 20, the temperatures of the processing solutions, the processing time of each processing step and the composition of each processing solution are shown below:

| Processing step | Temperature | Time |
|---|---|---|
| Development | 42° C. | 25 sec. |
| Bleaching/fixing | 38° C. | 25 sec. |
| Rinsing (1) | 38° C. | 20 sec. |
| Rinsing (2) | 38° C. | 20 sec. |
| Rinsing (3) | 38° C. | 20 sec. |
| (Drying | 80° C. | 40 sec.) |

(As described above, the rinsing solution reversely flows from the third rinsing tank 56 to the first rising tank 52.)

| Developing solution | |
|---|---|
| Water | 800 ml |
| Ethylenediaminetetraacetic acid | 3.0 g |
| Disodium 4,5-dihydroxybenzene-1,3-disulfonate | 0.5 g |
| Triethanolamine | 12.0 g |
| Potassium chloride | 10.0 g |
| Potassium bromide | 0.03 g |
| Potassium carbonate | 27.0 g |
| Brightening agent (WHITEX 4, Sumitomo Chemical Co.) | 1.0 g |
| Sodium sulfite | 0.1 g |
| Disodium-N,N-bis(sulfonatoethyl) hydroxylamine | 5.0 g |
| Sodium triisopropylnaphtalene (β)sulfonate | 0.1 g |
| N-Ethyl-N-(β-methanesulfonamide ethyl)-3-methyl-4-aminoaniline 3/2 sulfuric acid.1$H_2O$ | 7.0 g |
| Total amount after adding water | 1.0 liter |
| pH (25° C., adjusted with potassium hydroxide and sulfuric acid) | 10.20 |
| **Bleaching/fixing solution** | |
| Water | 600 ml |
| Ammonium thiosulfate (750 g/liter) | 93 ml |
| Ammonium sulfite | 40 g |
| Iron (III) (ethylenediamine-tetraacetate) ammonium | 55 g |
| Ethylenediaminetetraacetic acid | 5 g |
| Nitric acid (67%) | 30 g |
| Total amount after adding water | 1.0 liter |
| pH (25° C., adjusted with acetic acid and ammonia water) | 5.8 |
| **Rinsing solution** | |
| Sodium chlorinated isocyanurate | 0.02 g |
| Deionized water (conductivity: not more than 5 μs/cm) | 1000 ml |
| pH | 6.5 |

Next, the operation of the present embodiment will be described.

When an unillustrated power switch of the photographic processing apparatus 10 is turned on, a start-up operation is started. In the start-up operation, the control unit 86 turns on the cartridge heaters 78 and 80 and the cast heater 100 and operates the circulating pumps 72, 74 and 76A–76J, so that all the processing solutions of the film processing section 16 and the printing paper processing section 24 are heated respectively to predetermined temperatures. When the processing solutions reach their respective predetermined temperatures, the cartridge heaters 78 and 80, the cast heater 100, and the cooling fans 82, 84 and 106 are controlled in an on-and-off manner to maintain the temperatures of the processing solutions within respective predetermined temperature ranges (in the present embodiment, the developing solutions are maintained at 42±0.5° C., and the remaining processing solutions are maintained at 38±0.5° C.).

After the processing solutions of the film processing section 16 and the printing paper processing section 24 reach the predetermined temperatures and the start-up operation of the apparatus is completed, the development of the negative film 12 is started.

In the film processing section 16, the negative film 12 which has been exposed is pulled out from the cartridge 14 and is fed into the developing tank 26 in which the negative film 12 is immersed in the developing solution which is stored in the developing tank 26 and is maintained at a predetermined temperature. Thereafter, the negative film 12 pulled out from the developing tank 26 is successively immersed in the bleaching solution, the fixing solution, the washing water and the stabilizer, which are maintained at the predetermined temperatures. After dry air is jetted to the negative film 12 in the drying compartment 42 so as to dry the negative film, it is fed out to the reservoir section 44.

In the image exposure section 22, the negative film 12 which has undergone the development and drying is pulled in from the reservoir section 44 while the printing paper 20 is pulled out from the magazine 18 so as to print on the printing paper 20 images recorded on the negative film 12. The printing paper 20 is then fed to the reservoir section 46.

The printing paper 20 which has been fed to the reservoir section 46 after exposure is pulled into the printing paper processing section 24 so as to immerse the printing paper into the developing solution, the bleaching/fixing solution and the rinsing solution, which are maintained at the predetermined temperatures, respectively. After the developing, bleaching/fixing and rinsing processes, the printing paper 20 is dried in the drying compartment 58 and discharged therefrom. The printing paper 20 discharged from the drying compartment 58 is cut in a frame-by-frame fashion, so that photographic prints corresponding to the images recorded on the negative film 12 can be obtained.

In the photographic processing apparatus 10, the developing solution in the developing tank 26 used for developing the negative film 12 and the developing solution in the developing tank 48 used for developing the printing paper 20 are maintained at the predetermined temperatures (42±0.5° C.) by the cartridge heaters 78 and 80 and the cooling fans 82 and 84, respectively, and the developing solutions are replenished in accordance with the processing amounts of the negative film 12 and the printing paper 20. Accordingly, the negative film 12 and the printing paper 20 can be processed under constant and optimal conditions from beginning to end. Especially, since the circulation amount of the developing solution in the film processing section 16 is maintained constant by using the flow meter 90, unevenness in the finished negative film 12 caused by excessive or insufficient circulation does not occur.

In the photographic processing apparatus 10, the bleaching solution, fixing solution, washing water and stabilizer of the film processing section 16, and the bleaching/fixing solution and rinsing solution of the printing paper processing section 24 are maintained at a constant temperature (38±0.5° C.) by the cast heater 100 and the cooling fan 106 so as to process with constant quality the negative film 12 and the printing paper 20 which have been immersed in the developing solutions. That is, the bleaching solution, the fixing solution, the washing water, and the stabilizer into which the negative film 12 is immersed for processing, and the bleaching/fixing solution and the rinsing solution into which the printing paper 20 is immersed for processing are heated by the single cast heater 100, thereby controlling the temperatures thereof.

In the conventional apparatus, a heater is provided for each processing solution or each processing tank to heat the bleaching solution, fixing solution, washing water and stabilizer of the film processing section 16, and the bleaching/fixing solution and rinsing solution of the printing paper processing section 24. By contrast, in the photographic processing apparatus 10, these six kinds of processing solutions are heated using the single cast heater 100. This greatly reduce the number of the heaters. As shown in FIG. 3, the pipes 70A–70J for circulating the processing solutions are bundled and coupled by the metal block 104 of the cast heater 100 without separately attaching heaters to the pipes 70A–70J. Hence, the pipes 70A–70J can be arranged in order inside the apparatus. Also, the internal structure of the apparatus can be simplified.

When the processing tanks which store processing solutions having different temperatures are arranged close to each other, the temperatures of the processing solutions affect each other, making the temperature control difficult. Accordingly, the processing tanks must be separated from each other to reduce the influence caused from differences in temperature among the processing solutions in the processing tanks. This makes it difficult to reduce the size of the apparatus in which the film processing section and the printing paper processing section are integrally arranged.

By contrast, in the photographic processing apparatus 10, the developing solution of the film processing section 16 and the developing solution of the printing paper processing section 24 are both maintained at 42° C., and the processing solutions of the film processing section 16 and the printing paper processing section 24 except the developing solutions are maintained at 38° C. Accordingly, even when the processing tanks which store different processing solutions are arranged close to each other, the temperature of one processing solution is prevented from affecting the temperatures of other processing solutions. Hence, the film processing section 16 and the printing paper processing section 24 can be arranged close to each other, which eliminates the necessity of a clearance between the film processing section 16 and the printing paper processing section 24, thereby making it possible to reduce the overall size of the apparatus.

To maintain the plurality of processing solutions at the predetermined temperatures by using the cast heater 100, the heater unit 102 is turned on when the temperature of one of the processing solutions becomes lower than the predetermined temperature range, and is turned off when the temperature of one of the processing solutions reaches the upper limit of the predetermined temperature range. When the temperature of one of the processing solutions exceeds the predetermined temperature range, the fan 106 is turned on to cool off the metal block 104. Therefore, the control unit 86 is not required to individually control the temperatures of the plurality of processing solutions, so that the temperature control for the processing solutions becomes considerably simple.

Among the processing solutions flowing through the pipes 70A–70J, if a processing solution or processing solutions have temperatures higher than that of the metal block 104, the temperatures of such processing solutions decrease due to heat exchange between the processing solutions and the metal block 104. A processing solution or processing solutions having temperatures lower than that of the metal block 104 are heated by heat from the metal block 104 so that the temperatures of such processing solutions rise. In other words, mutual adjustment is performed among the processing solutions such that the temperatures of the metal block 104 having a high thermal conductivity and the temperatures of the processing solutions flowing inside the pipes 70A–70J are equalized relative to each other through the metal block 104.

By simultaneously controlling the temperatures of the plurality of processing solutions using the cast heater 100, it becomes possible to mutually control the temperatures of the processing solutions, unlike the conventional apparatus in which the temperatures of the processing solutions are separately controlled. This simplifies the temperature control for the processing solution and makes the temperature control more efficient.

In the photographic processing apparatus 10, the developing solution of the film processing section 16 and the developing solution of the printing paper processing section 24 are maintained at 42° C. which is higher than the temperature of developing solutions in a conventional apparatus (not greater than 38° C.). Hence, the development of the negative film 12 and the printing paper 20 can be accelerated. Also, since all the processing solutions except the developing solutions are maintained at 38° C. or higher, which is higher than the temperatures of the processing solutions in the conventional apparatus, the processing of the negative film 12 and the printing paper 20 in the respective processing solution can be accelerated. Accordingly, in the photographic processing apparatus 10, the development of the negative film 12 and the printing paper 20 using the respective processing solutions can be performed in a quicker manner.

Figure 5:
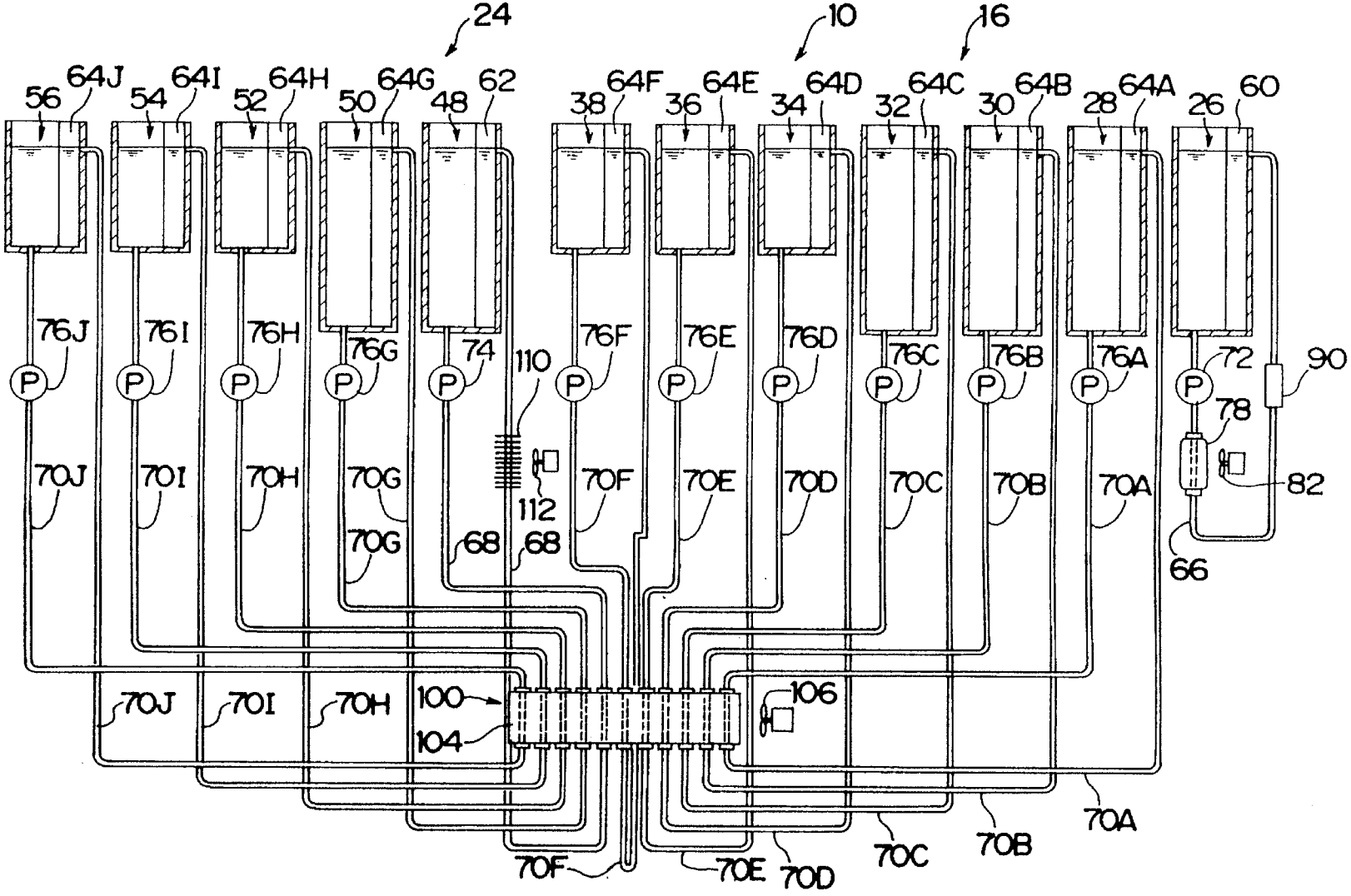
FIG. 5 is a schematic diagram of another piping arrangement which can be used in the photographic processing apparatus.
Figure 6A:
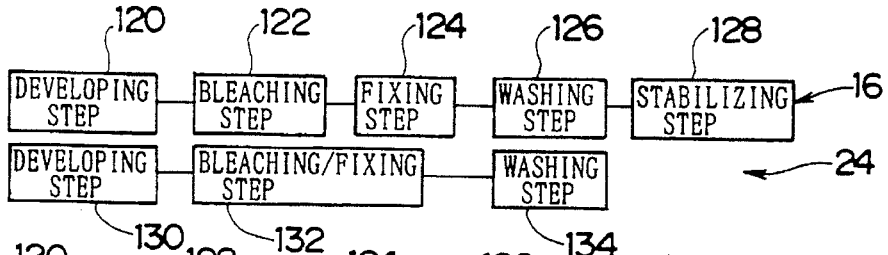
FIGS. 6A–6G are block diagrams showing various combination of processing stages of a film processing section and a printing paper processing section which can be applied to the photographic processing apparatus according to the present invention.
Figure 6B:
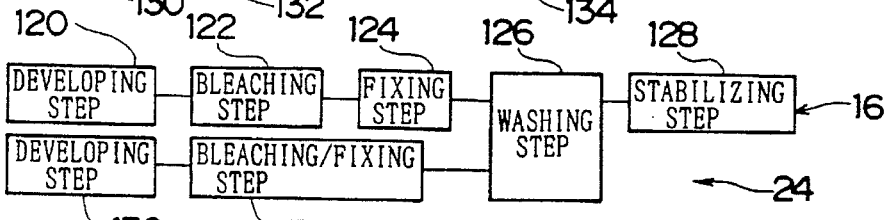
Figure 6C:
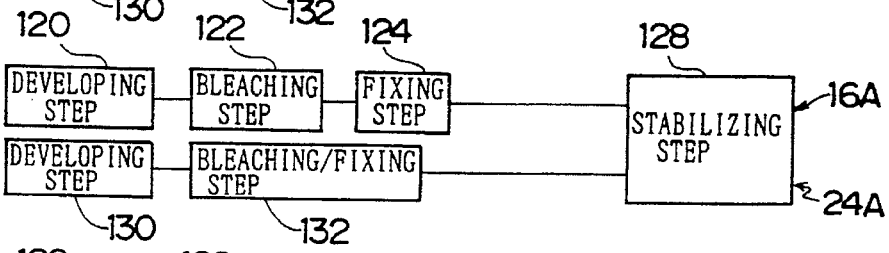
Figure 6D:
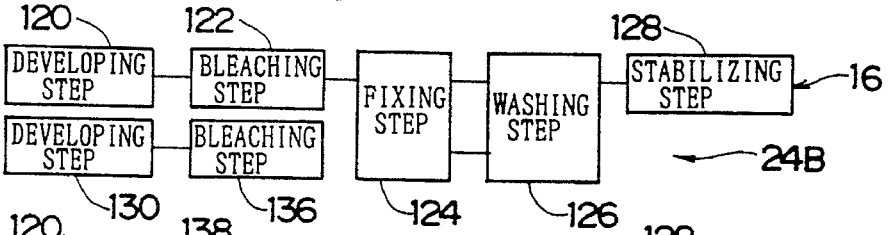
Figure 6E:
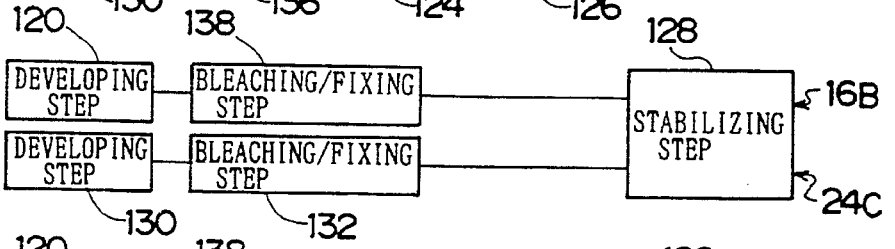
Figure 6F:
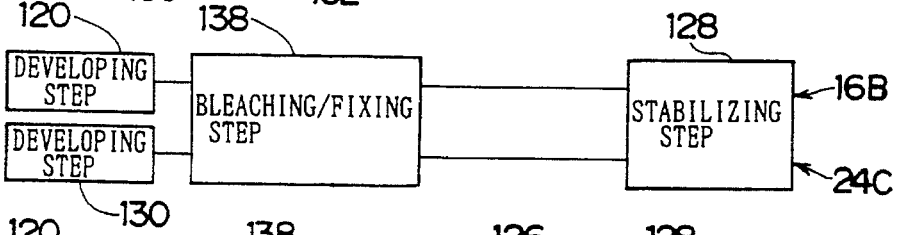
Figure 6G:
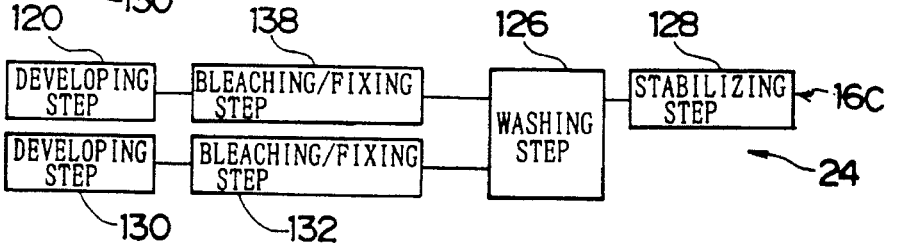

In the above-described embodiment, the plurality of processing solutions are maintained at predetermined temperatures by three heat sources. That is, the temperatures of the developing solutions of the film processing section 16 and the printing paper processing section 24 are controlled by the cartridge heaters 78 and 80, and the temperatures of other processing solutions are controlled by the cast heater 100. However, as shown in FIG. 5, for example, the pipe 68 communicating with the developing tank 48 of the printing paper processing section 24 may be bundled together with other pipes 70A–70J and coupled to the cast heater 100. This further reduce the number of the heat sources for heating the processing solutions.

In this case, when the preset temperature of the developing solution in the developing tank 48 of the printing paper processing section 24 is desired to be different from the preset temperatures of other processing solutions, an auxiliary temperature adjusting means is attached to the pipe 68 between the cast heater 100 and the subtank 62. The temperature adjusting means includes, for example, a large number of fins 110 attached to the pipe 68 and a fan 112 which supplies the fins 110 with cool air or hot air, to adjust the temperature of the developing solution.

The present invention is not limited to the above, and the developing solutions of the film processing section 16 and the printing paper processing section 24 may be heated by a common heater. In this case, an unillustrated cast heater having a structure simpler than the cast heater 100 may be used.

Although the processing solutions, except the developing solutions of the film processing section 16 and the printing paper processing section 24, are heated together by the cast heater 100 in the present embodiment, the pipes 70A–70J may be divided into a plurality of groups each of which is coupled together by a separate cast heater. Even in this case, the number of heaters can be greatly reduced compared to the conventional apparatus.

In such a manner, in the case where the number of the heaters (cast heater and cartridge heaters) is increased compared to the photographic processing apparatus 10 shown in FIG. 2, the total number of the heaters is preferably limited to a number not greater than 4, more preferably not greater than 3 so as to achieve the objects of the present invention, i.e., the reduction of the number of parts, and the reduction of the running costs of the apparatus, and to present the remarkable effect thereof.

In the present embodiment, the temperatures of the developing solutions are maintained at 42° C. and the temperatures of the processing solutions except the developing solutions are maintained at 38° C. However, this setting of the temperatures is an example, and the object of the present invention can be sufficiently achieved when the temperatures of the developing solutions are maintained at temperatures equal to or more than 40° C., and the temperatures of the processing solutions except the developing solutions are maintained at temperatures in the range of 38°–50° C., including 38° C. and 50° C. When the developing solutions are maintained at temperatures lower than 40° C. and the processing solutions except the developing solutions are maintained at temperatures lower than 38° C., the processing speed becomes the same as that in the conventional apparatus.

The cartridge heaters 78 and 80 used in the present embodiment may be cartridge heaters in which heaters are inserted into the fluid passages through which the processing solutions flow. Also, it is possible to use various types of heaters having ordinary structures such as a cast heater in which a single pipe and a heater are embedded in a metal block, and a pipe heater in which a heater is closely contacted to the pipe provided with an integral metal block.

As described above, the method of processing a photosensitive material according to the present invention can process a color photosensitive material in a quicker manner. Since the differences in temperature among the processing solutions, except the developing solutions, are controlled to be at most 2° C., the temperatures of the processing solutions can be prevented from affecting each other even when the processing tanks storing different processing solutions are closely arranged each other. Therefore, the size of the apparatus can be reduced.

Also, since the differences in temperature among the processing solutions except the developing solutions are controlled to be at most 2° C., the plurality of processing solutions can be heated by a single heat source. Accordingly, the number of heaters serving as heat sources and the number of parts for controlling the heaters can be reduced, and the structure of the apparatus can be simplified. Also, the electrical power consumed by the apparatus can be reduced so as to decrease the running costs.

While the embodiments of the present invention, as herein disclosed, constitute a preferred form, it is to be understood that other forms might be adopted.

What is claimed is:

1. A method of developing a photosensitive material, using a plurality of processing solutions including a developing solution, said method comprising the steps of:

placing each of said processing solutions in respective tanks;

heating said processing solutions, except the developing solution, by at most a first heating source and a second heating source; wherein the developing solution is maintained at a predetermined temperature equal to or higher than 40° C., and the remaining processing solutions are maintained at predetermined temperatures in a range from at least 38° C. to at most 50° C. while maintaining the temperature differences between the processing solutions, except the developing solution, to be less than or equal to 2° C.

2. A photographic processing apparatus comprising:

a film processing section in which a photographic film is developed using processing solutions, including a developing solution;

an image exposure section for printing images of the photographic film on a printing paper by exposure; and a printing paper processing section in which the printing paper is developed using processing solutions, including a developing solution;

at most a first heating source and a second heating source for maintaininq said processing solutions, except the developing solutions, at predetermined temperatures, wherein the temperature differences between the processing solutions, except the developing solutions, of said film processing section and said printing paper processing section are maintained to be less than or equal to 2° C.

3. A photographic processing apparatus according to claim 2, wherein the developing solution of said film processing section and the developing solution of said printing paper processing section are maintained at predetermined temperatures equal to or higher than 40° C., and remaining the processing solutions of said film processing section and the remaining solutions of said printing paper processing section are maintained at predetermined temperatures in a range from at least 38° C. to at most 50° C.

4. A photographic apparatus according to claim 3, further comprising:

pipes for circulating the processing solutions, wherein the processing solutions, except the developing solution of said film processing section and the developing solution of said printing paper processing section, are heated by at most a first and second heating source, wherein said first heating source comprises a cast heater wherein said first heating source and said pipes are coupled together by a material having a high heat conductivity.

5. A photographic processing apparatus according to claim 4, wherein all the processing solutions, except the developing solution of said film processing section and the developing solution of said printing paper processing section, are maintained at predetermined temperatures by a single cast heater.

6. A photographic processing apparatus according to claim 2, further comprising:

pipes for circulating the processing solutions, wherein the processing solutions, except the developing solution of said film processing section and the developing solution of said printing paper processing section, are heated by at most a first and second heating source, wherein said first heating source comprises a cast heater wherein said first heating source and said pipes are coupled together by a material having a high heat conductivity.

7. A photographic processing apparatus according to claim 6, wherein all the processing solutions, except the developing solution of said film processing section and the developing solution of said printing paper processing section, are maintained at predetermined temperatures by a single cast heater.

8. A photographic processing apparatus comprising:

a film processing section in which a photographic film is developed using processing solutions, including a developing solution;

a printing paper processing section in which a printing paper containing an image is developed using processing solutions, including a developing solution; and at most a first heating source and a second heating source for maintaining said processing solutions, except the developing solutions, at predetermined temperatures, wherein the temperature differences between the processing solutions, except the developing solutions, of said film processing section and said printing paper processing section are maintained to be less than or equal to 2° C.

9. A photographic processing apparatus according to claim 8, further comprising:

pipes for circulating the processing solutions, wherein the processing solutions, except the developing solution of said film processing section and the developing solution of said printing paper processing section, are heated by at most a first and second heating source, wherein said first heating source comprises a cast heater wherein said first heating source and said pipes are coupled together by a material having a high heat conductivity.

10. A photographic processing apparatus according to claim 9, wherein all the processing solutions, except the developing solution of said film processing section and the developing solution of said printing paper processing section, are maintained at predetermined temperatures by a single cast heater.

* * * * *